US008678786B2

(12) United States Patent
Tang et al.

(10) Patent No.: US 8,678,786 B2
(45) Date of Patent: Mar. 25, 2014

(54) SCROLL COMPRESSOR WITH PARTIAL UNLOADER FOR START-UP

(75) Inventors: Benjamin Tang, San Gabriel, CA (US); Ralph Robert Rivet, Torrance, CA (US); Ralph Leclercq, Palos Verdes Penisula, CA (US)

(73) Assignee: Honeywell International Inc., Morristown, NJ (US)

( * ) Notice: Subject to any disclaimer, the term of this patent is extended or adjusted under 35 U.S.C. 154(b) by 341 days.

(21) Appl. No.: 12/909,042

(22) Filed: Oct. 21, 2010

(65) Prior Publication Data

US 2012/0100024 A1 Apr. 26, 2012

(51) Int. Cl.

| | |
|---|---|
| ***F01C 1/107*** | (2006.01) |
| ***F04C 18/107*** | (2006.01) |
| ***F04C 18/02*** | (2006.01) |
| ***F04C 27/00*** | (2006.01) |

(52) U.S. Cl.

CPC ..... *F04C 18/0215* (2013.01); *F04C 27/006* (2013.01)

USPC ..... 417/410.5; 418/55.5

(58) Field of Classification Search

CPC ..... F04C 18/215; F04C 23/008; F04C 27/006

USPC ..... 417/410.5, 902; 418/55.5, 57, 418/55.1–55.4, 55.6

See application file for complete search history.

(56) References Cited

U.S. PATENT DOCUMENTS

| | | | | |
|---|---|---|---|---|
| 5,074,123 | A * | 12/1991 | Iida et al. | 62/228.5 |
| 6,412,293 | B1 | 7/2002 | Pham et al. | |
| 7,419,370 | B2 * | 9/2008 | Masuda | 418/55.5 |
| RE40,553 | E | 10/2008 | Ichihara | |
| 7,442,017 | B2 | 10/2008 | Tsuchiya et al. | |
| 2005/0253107 | A1 * | 11/2005 | Flynn et al. | 252/67 |
| 2007/0269326 | A1 * | 11/2007 | Seibel et al. | 418/55.1 |
| 2008/0159892 | A1 * | 7/2008 | Huang et al. | 418/55.1 |

* cited by examiner

*Primary Examiner* — Bryan Lettman

(74) *Attorney, Agent, or Firm* — Shimokaji & Associates, P.C.

(57) ABSTRACT

A scroll compressor may be provided with a check valve interposed between a balance chamber and a discharge chamber. The check valve may allow balance chamber pressure to remain low during start-up of the compressor. Low balance chamber pressure may allow an orbiting scroll to remain unclamped to a fixed scroll thereby reducing torque required to initiate rotation of the orbiting scroll. After steady-state operational speed is reached the check valve may close and the scrolls may be clamped together to produce a desired steady-state operating condition for the compressor.

6 Claims, 4 Drawing Sheets

SCROLL COMPRESSOR WITH PARTIAL UNLOADER FOR START-UP

BACKGROUND OF THE INVENTION

The present invention generally relates to refrigeration compressors. More particularly, the invention relates to a system for providing a scroll compressor with low starting torque.

Scroll compressors may be employed to compress refrigerant gas in cooling systems. In a particular application, a scroll compressor may be used in a distributed cooling system of a commercial aircraft. In that context, the scroll compressor may be required to start compression of refrigerant gas in high temperature conditions. For example, the aircraft may be positioned on the ground at a location with a high ambient temperature (e.g. air temperature of 110° F. or higher). In such a case, aircraft equipment bay temperature may be as high as 160° F. Consequently vapor pressure at an inlet side of an idle compressor may be as high as 200 to 250 psia.

A conventional scroll compressor may require application of high torque during start-up under these circumstances. In order to assure that high starting torque may be available; a conventional aircraft cooling system may be constructed with a high-torque motor for driving the compressor. A driving motor that is sized to provide high starting torque may be larger and heavier than a motor that may be sized only to accommodate steady state operational loads of the compressor. In that regard, the conventional compressor may be considered to need an oversized motor. A high-torque driving motor may also require a high capacity (i.e., oversized) inverter to provide a high level of AC current for the motor during compressor start-up. Oversized motors and inverters may add undesirable weight and cost to an aircraft.

As can be seen, there is a need for an aircraft cooling system in which a scroll compressor may be operated with a motor that may be sized in accordance with the compressor's steady state operational loads. Additionally there is a need for a scroll compressor which may be started with such a motor irrespective of ambient temperature in which the aircraft may be present.

SUMMARY OF THE INVENTION

In one aspect of the present invention, a distributed cooling system for an aircraft may comprise: an evaporator-chiller; and a scroll compressor for compressing refrigerant from the evaporator-chiller, wherein the clamping force between an orbiting scroll and a fixed scroll of the compressor is produced by pressure in a balance chamber of the compressor, and wherein the pressure in the balance chamber is equalized with inlet pressure of the compressor at start-up so that starting torque of the compressor is reduced.

In another aspect of the present invention, a scroll compressor may comprise a check valve interposed between a balance chamber and a discharge chamber, wherein the check valve is adapted to permit flow of refrigerant gas from the balance chamber into the discharge chamber whenever gas pressure in the discharge chamber is less than gas pressure in the balance chamber.

In still another aspect of the present invention, a method for starting a scroll compressor may comprise: opening a gas flow passage between a balance chamber and a discharge chamber of the compressor; initiating rotation of an orbiting scroll while the gas flow passage is open; and closing the gas flow passage after the orbiting scroll is at its steady state operating speed.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

The present invention generally provides a cooling system that uses a scroll compressor for compressing refrigerant wherein the scroll compressor is provided with an internal check valve that allows the compressor to start with a low starting torque.

Figure 1:
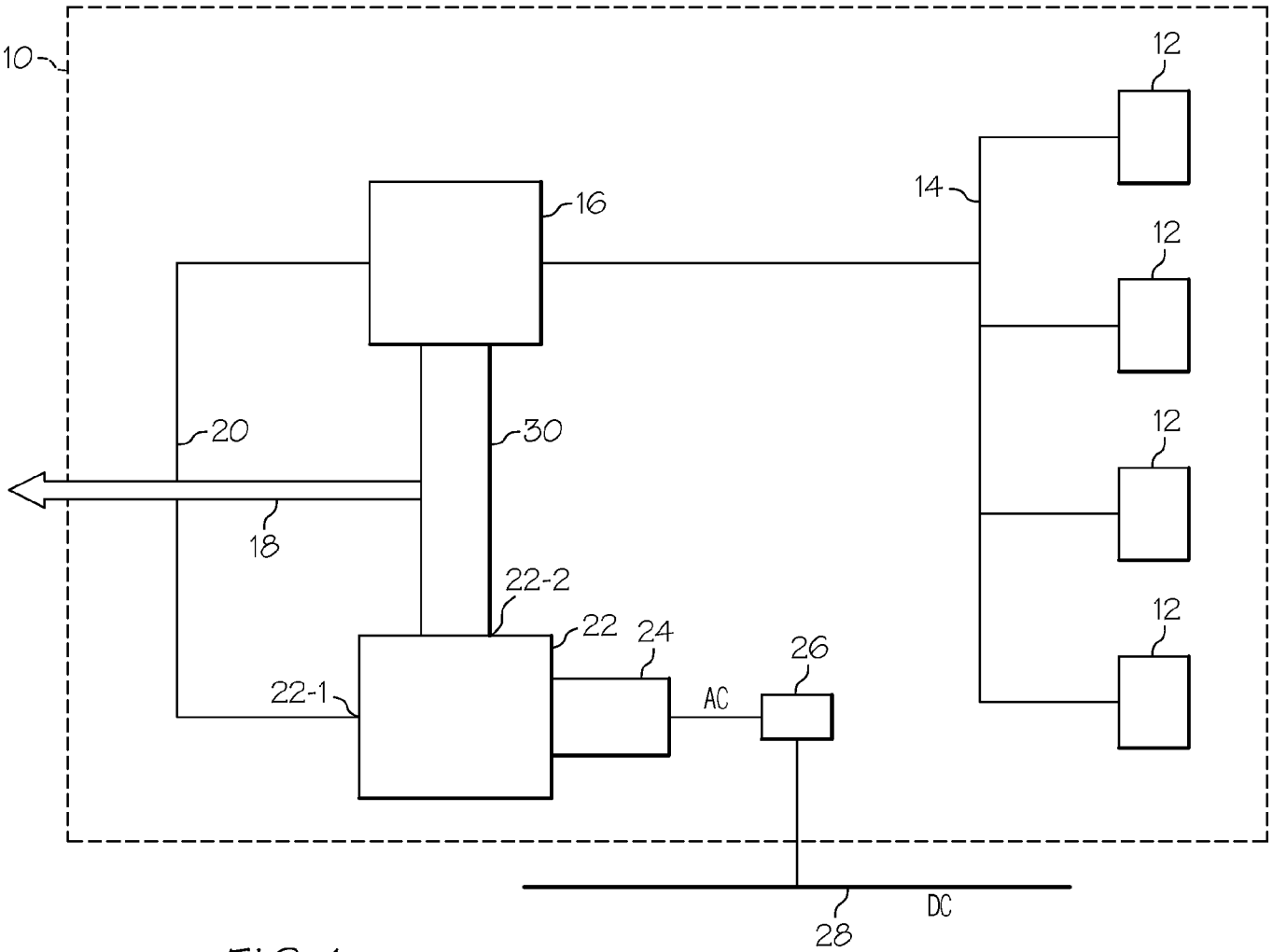
FIG. 1 is a block diagram of a distributed cooling system in accordance with an embodiment of the invention.

Referring now to FIG. 1, a distributed cooling system 10 is shown in block diagram format. In an exemplary embodiment of the invention, the system 10 may comprises a plurality of cooled storage boxes 12 which may be used for storing food and beverage on a commercial aircraft (not shown). In the system 10, heat from the boxes 12 may be extracted through a fluid-filled cooling circuit 14 and conveyed to an evaporator-chiller 16. The evaporator-chiller 16 may extract heat from the cooling circuit 14. Heated air may be removed from the aircraft though an exhaust passage 18.

A refrigerant circuit 20 may interconnect the evaporator-chiller 16 to a compressor 22 at an inlet side 22-1. In an exemplary embodiment of the invention, the compressor 22 may be a scroll compressor. The compressor 22 may be driven by an AC motor 24 which may be provided with electrical power through a dedicated inverter 26 which may be connected to a DC bus 28 of the aircraft. The compressor 22 may be interconnected, at an outlet side 22-2, to the evaporator-chiller 16 through a condenser 30.

Figure 2:
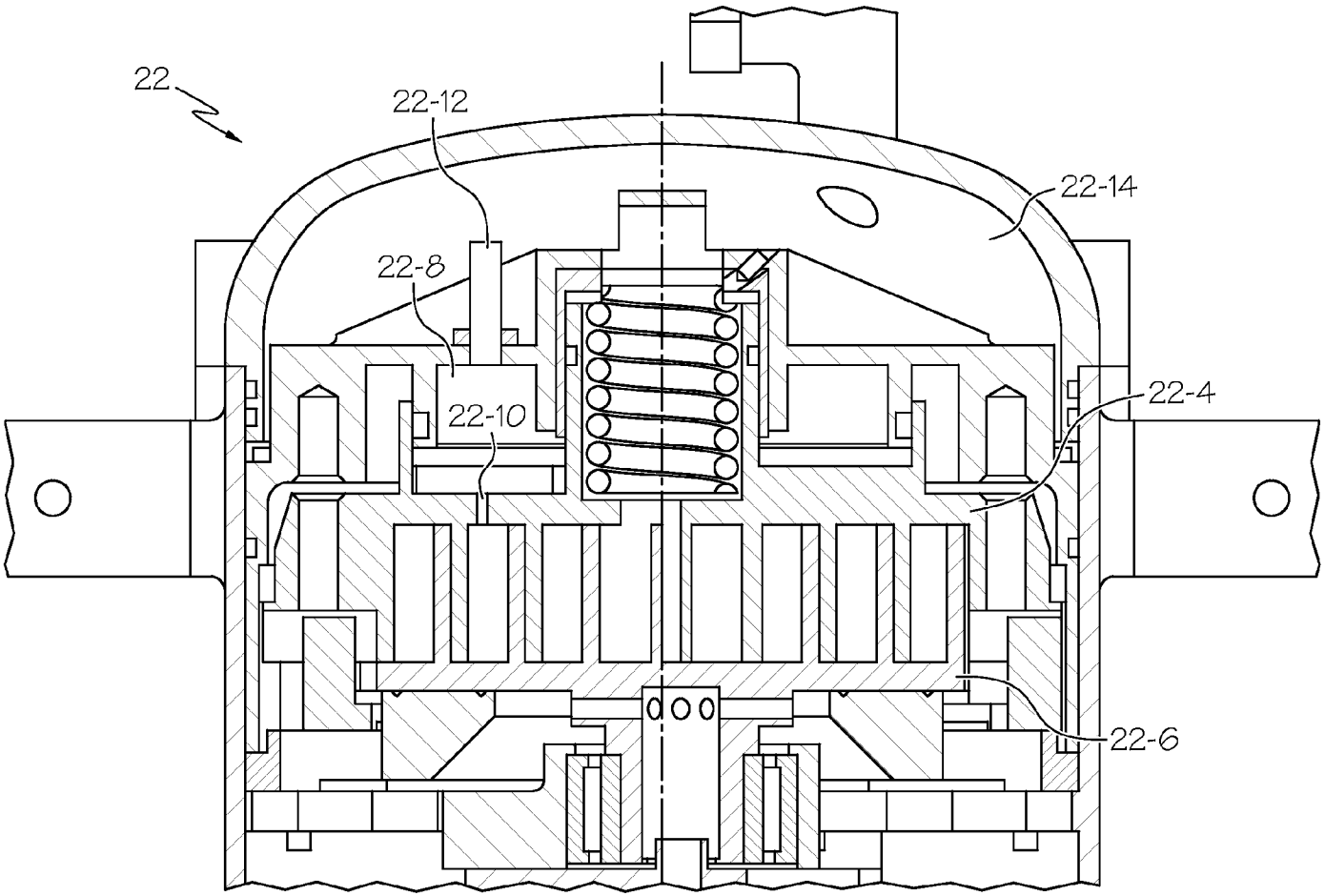
FIG. 2 is cross-sectional view of a scroll compressor in accordance with an embodiment of the invention.

Referring now to FIG. 2, the compressor 22 may be seen in a cross-sectional format. In an exemplary embodiment, the compressor 22 may comprise a fixed scroll 22-4 and an orbiting scroll 22-6. In operation, the compressor 22 may employ an axial pressure balance system, wherein an intermediate pressure between the fixed scroll 22-4 and the orbiting scroll 22-6 may be fed into a balance chamber 22-8. The balance chamber 22-8 may be adjacent the fixed scroll 22-4 (as shown in FIG. 2) or, in an alternate embodiment (not shown), the balance chamber 22-8 may be adjacent the orbiting scroll 22-6.

This intermediate pressure may be referred to as balance pressure. The balance pressure may be proportional to compressor inlet pressure. The proportionality may be a function of location of a bleed hole 22-10. The balance pressure may create a clamping force that may counteract an axial separation force that may be proportional to compressor inlet pressure. The clamping force may keep the fixed scroll 22-4 and the orbiting scroll 22-6 in sealed contact with each other. This sealed contact may reduce leakage of refrigerant from a high pressure side to a low pressure side.

A check valve 22-12 may be positioned between the balance chamber 22-8 and a discharge chamber 22-14. The check valve 22-12 may provide a gas flow passage for refrigerant gas from the balance chamber 22-8 into the discharge chamber 22-14 during start-up of the compressor 22. It must be noted that at start-up, inlet pressure and outlet pressure are substantially equal. Thus the check valve 22-12 allows pressure in the balance chamber 22-8 to be substantially equal to outlet pressure. Consequently, a differential between balance pressure and outlet pressure may be substantially absent at initiation of start-up. Because of this virtual absence of pressure differential, the fixed scroll 22-4 and orbiting scroll 22-6 may move freely relative to one another. In other words, there may be virtually no torque needed to initially rotate the orbiting scroll 22-6.

It may be seen that, even if inlet pressure is high, the check valve 22-12 may allow balance pressure to be no higher than outlet pressure.

Figure 3:
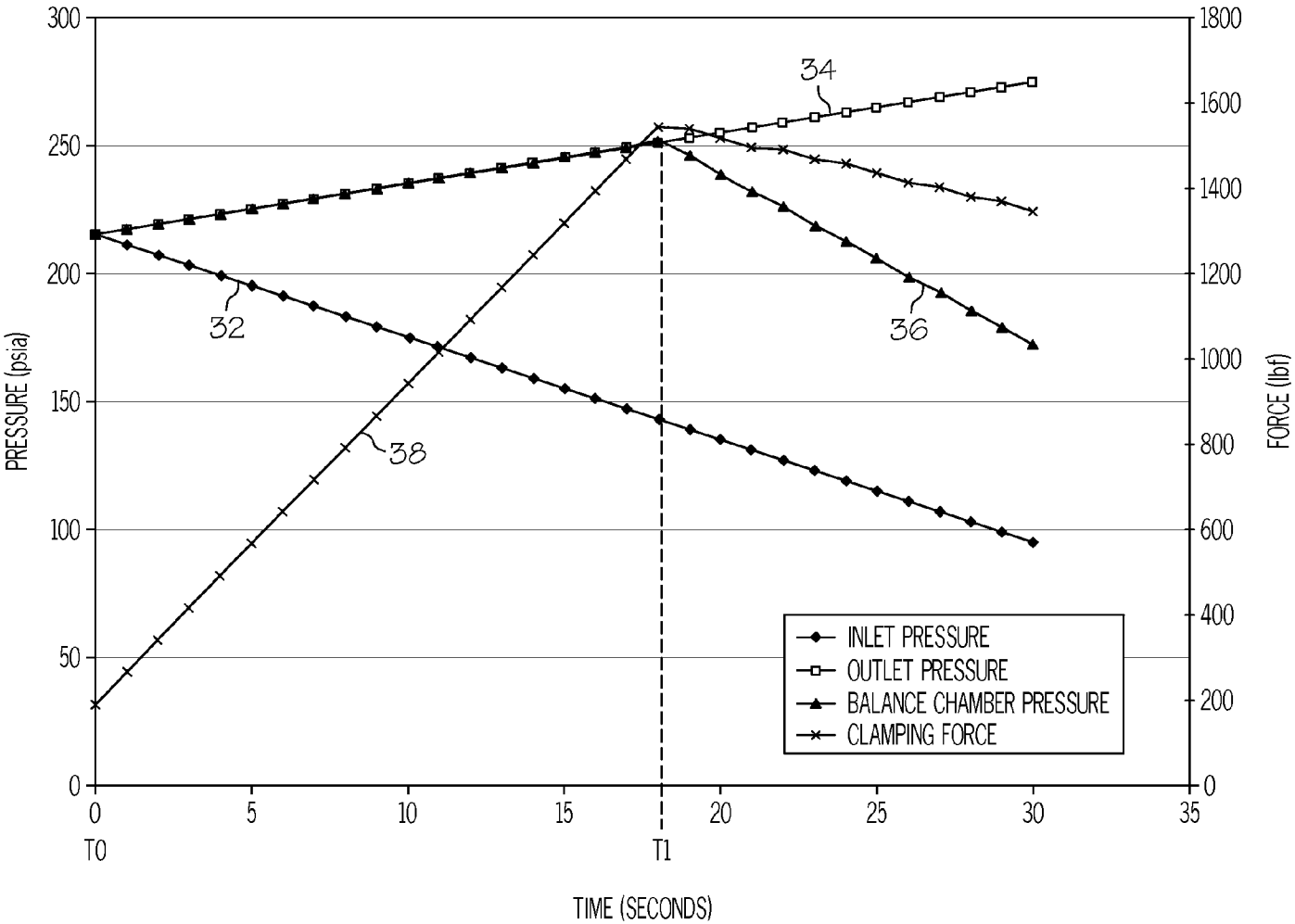
FIG. 3 is a collection of graph lines that illustrate dynamics of operation of the scroll compressor of FIG. 2 in accordance with an embodiment of the invention.

Referring now to FIG. 3, a series of graph lines may illustrate dynamics of the compressor 22 during start-up. FIG. 3 illustrates possible start-up operation of the compressor 22 on a hot day when initial inlet pressure, shown as graph line 32, may be particularly high (e.g. about 210 psia). At time T0 outlet pressure (graph line 34) may be equal to inlet pressure 32. Also at T0, balance pressure (graph line 36) may be only slightly greater than inlet pressure 32 and/or outlet pressure 34, because the check valve 22-12 of FIG. 2 may allow equalization of outlet pressure 34 and balance pressure 36. A slight difference between balance pressure 36 and outlet pressure 34 may result from a small pressure drop in the flow through the check valve 22-12. This differential may kept relatively low by employing a high-flow check valve as the check valve 22-12.

Because, at T0, there may be virtually no differential between balance pressure 36 and inlet pressure 32, clamping force (graph line 38) may be low. As described above low clamping force may result in low starting torque requirement.

It may also be seen that as start-up progresses, inlet pressure 32 may drop and outlet pressure 34 may increase. In other words, a differential between balance pressure 36 and inlet pressure 32 may increase as start-up progresses. Within a short time period, at a time T1, (which in an exemplary embodiment may be about 20 seconds) the balance pressure 36 and the outlet pressure 34 may equalize. At that time, the check valve 22-12 may close, but the inlet pressure 32 at time T1 may be lower than the inlet pressure at time T0. At time T1, the clamping force 38 may have increased to its normal operational level so the scrolls 22-4 and 22-6 may be sealed together. The compressor 22 may then be operational without undesirable leakage between the scrolls 22-4 and 22-6.

It may be noted that at time T1, inlet pressure 32 is reduced and rotational speed of the motor 24 (of FIG. 1) may have increased. Thus torque load on the motor 24 may be equivalent to steady state torque. In other words, start-up of the compressor 22 may be accomplished in accordance with the invention, without ever applying a torque load to the motor 24 that exceeds its maximum steady state torque load.

Figure 4:
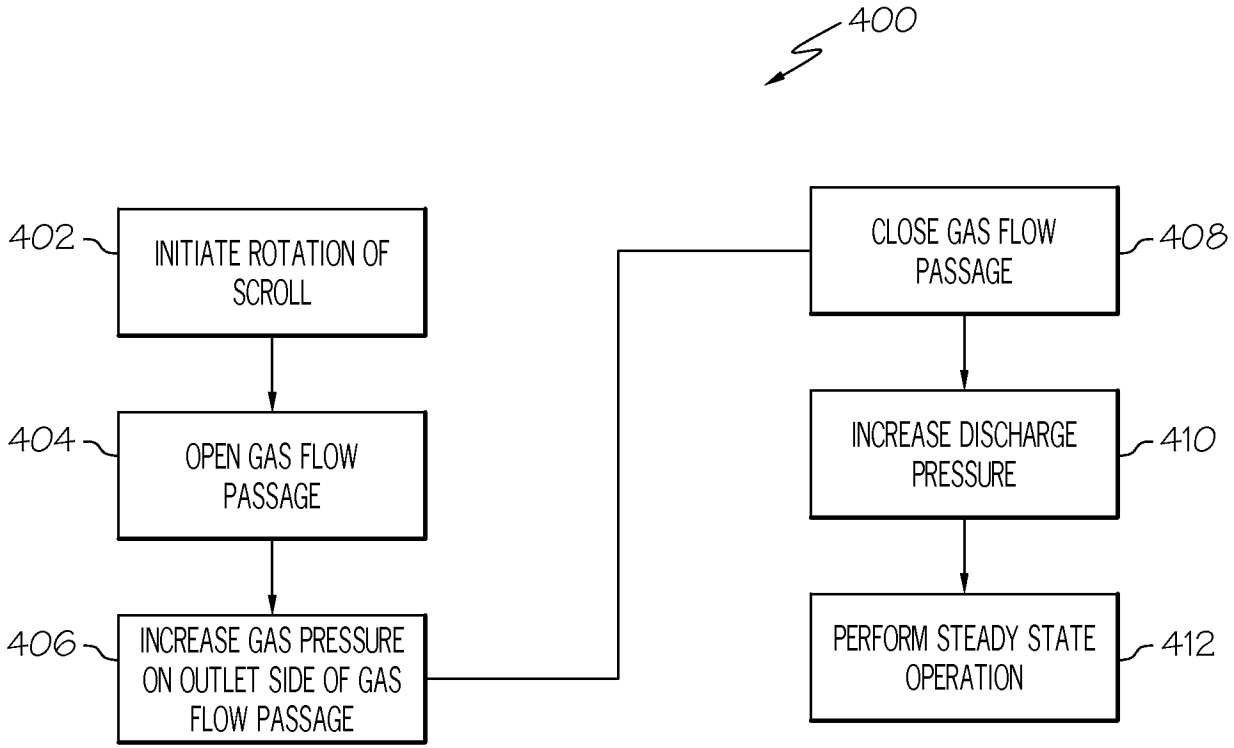
FIG. 4 is a flow chart of a method for starting a scroll compressor with a low starting torque in accordance with an embodiment of the invention.

Referring now to FIG. 4, an exemplary method 400 may be employed to start a scroll compressor with starting torque that is no greater than steady-state operational torque. In a step 402, orbiting of a scroll in the compressor may be initiated (e.g., the motor 24 may drive the orbiting scroll 22-6). In a step 404, a gas flow passage in the compressor may be opened (e.g., the check valve 22-12 may be opened to allow refrigerant gas flow between the balance chamber 22-8 and the discharge chamber 22-14 of the scroll compressor 22). In a step 406 gas pressure at an outlet side of the gas flow passage may be increased (e.g., interaction between the orbiting scroll 22-6 and the fixed scroll 22-4 may increase pressure in the discharge chamber 22-14). In a step 408, the gas flow passage may be closed (e.g., pressure in the discharge chamber 22-14 may exceed pressure in the balance chamber 22-8 so that the check valve 22-12 may close). In a step 410, clamping force between the orbiting scroll and the fixed scroll may be increased (e.g., pressure in the discharge chamber 22-14 may continue to increase, thereby increasing axial loading between the orbiting scroll 22-6 and the fixed scroll 22-4). In a step 412, steady state operation of the compressor may continue (e.g., with the scrolls 22-4 and 22-6 properly clamped together, the compressor 22 may compress refrigerant gas at its normal capacity).

It should be understood, of course, that the foregoing relates to exemplary embodiments of the invention and that modifications may be made without departing from the spirit and scope of the invention as set forth in the following claims.

We claim:

1. A scroll compressor comprising:

an orbiting scroll;

a fixed scroll parallel to a rotating axis of the orbiting scroll in an axial direction from the orbiting scroll and;

a balance chamber axially above and adjacent to the fixed scroll and configured to produce a clamping force between the fixed scroll and the orbiting scroll of the scroll compressor, wherein a gas pressure in the balance chamber changes based on proximity of a measured pressure point in the balance chamber to a bleed hole attached to the balance chamber, and wherein the balance chamber provides an unrestricted passage of gas between the bleed hole and a check valve;

a discharge chamber; and the check valve interposed in the axial direction between the balance chamber and the discharge chamber, and external to the balance chamber, wherein the check valve is immediately proximate to the balance chamber;

wherein the check valve is adapted to permit refrigerant gas to flow from the balance chamber into the discharge chamber when the scroll compressor is started so that a starting torque for the scroll compressor is independent of a vapor pressure of refrigerant at an inlet of the scroll compressor; and wherein the check valve is further configured to close after the orbiting scroll is at its steady state operating speed and increase the clamping force between the orbiting scroll and the fixed scroll.

2. The scroll compressor of claim 1, wherein the check valve has a flow rate capacity sufficient to allow a gas flow therethrough for about 20 seconds after an initial rotation of the orbiting scroll of the scroll compressor.

3. The scroll compressor of claim 1, wherein a torque required for an initial rotation of the orbiting scroll does not exceed a torque required for a steady state operation of the scroll compressor.

4. The scroll compressor of claim 1, wherein the clamping force between the orbiting scroll and the fixed scroll is a function of a differential between an inlet pressure of the scroll compressor and a pressure in the balance chamber.

5. The scroll compressor of claim 1, wherein a torque required for rotation of the orbiting scroll is a function of the clamping force between the orbiting scroll and the fixed scroll.

6. The scroll compressor of claim 1, wherein a torque required for an initial rotation of the orbiting scroll is not a function of an inlet pressure of the scroll compressor.

* * * * *